US008162461B2

(12) United States Patent
Iwata et al.

(10) Patent No.: US 8,162,461 B2
(45) Date of Patent: Apr. 24, 2012

(54) PRINTER

(75) Inventors: Naohiro Iwata, Yokohama (JP); Hiroyuki Kinoshita, Kawasaki (JP); Hideyuki Terashima, Kawasaki (JP); Akihiro Tomoda, Yokohama (JP); Ryosuke Sato, Kawasaki (JP); Kosuke Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 360 days.

(21) Appl. No.: 12/430,435

(22) Filed: Apr. 27, 2009

(65) Prior Publication Data

US 2009/0278902 A1 Nov. 12, 2009

(30) Foreign Application Priority Data

May 8, 2008 (JP) ..... 2008-122401
Mar. 4, 2009 (JP) ..... 2009-050921

(51) Int. Cl.
*B41J 2/175* (2006.01)

(52) U.S. Cl. ..... 347/87

(58) Field of Classification Search ..... None
See application file for complete search history.

(56) References Cited

U.S. PATENT DOCUMENTS 5,784,082 A 7/1998 Shinmachi et al.
5,872,581 A 2/1999 Yanagi et al.
6,027,212 A 2/2000 Tanno et al.
6,260,950 B1 7/2001 Tanno et al.
6,886,913 B2 * 5/2005 Nishiberi ..... 347/50
2008/0018705 A1 * 1/2008 Muhl ..... 347/49

FOREIGN PATENT DOCUMENTS

JP 2001-341320 12/2001
JP 2004-90343 3/2004
JP 2005-335230 12/2005
JP 2007-50527 3/2007

* cited by examiner

*Primary Examiner* — Matthew Luu
*Assistant Examiner* — Renee I Wilson
(74) *Attorney, Agent, or Firm* — Fitzpatrick, Cella, Harper & Scinto

(57) ABSTRACT

A printer includes a set cover pivotally movably provided on a carriage. The cover can be set in a closed state in which the cover presses a head of the cartridge housed in the housing portion and an open state in which the cover opens the housing portion when the cartridge is replaced. A release lever is subjected to a bias force so as to protrude from an inner wall surface of the housing portion. The release lever is movable against the bias force. The release lever comes into contact with an end of the cartridge which faces the bottom surface when the cartridge is inserted into the housing portion. The release lever contacts the rear surface of the cartridge housed in the housing portion. The bias force is stronger when the cover is in the open state than when the cover is in the closed state.

12 Claims, 9 Drawing Sheets

PRINTER

BACKGROUND OF THE INVENTION

1. Field of the Invention

The present invention relates to the field of a printer including a removable cartridge.

2. Description of the Related Art

Printers including a mechanism in which a head cartridge is removably installed in a carriage are known from Japanese Patent Application Laid-Open Nos. 2001-341320, 2007-050527, and 2005-335230. In these apparatuses, the carriage includes a cover that is pivotally opened and closed when the cartridge is installed in or removed from the carriage. To allow the cartridge to be replaced with a new one, the cover is opened. After new cartridge is inserted into the carriage, the cover is closed. The cross section of the cover is L-shaped. When the cartridge is inserted into the carriage and the cover is then closed, not only the top surface but also a part of the front surface of the cartridge is covered because of the L shape of the cover. On the other hand, when the cover is opened, the part of the cover which is bent into the L shape projects over the carriage to cover the carriage. Thus, when a user pulls out a used cartridge upward from the carriage or inserts a new cartridge into the carriage from above, only a narrow space is available for the replacing operation. This hinders the operation.

In the printer disclosed in Japanese Patent Application Laid-Open No. 2004-090343, the cover mechanism presses only the head of the cartridge. The cover is not L-shaped. Thus, when the cover is opened, only a small part of the cover shields the area over the carriage. Consequently, the cartridge replacing operation can be easily performed from above. However, when the user inserts the cartridge into the carriage, the electric contact points of the cartridge or those of the carriage may come into contact with a protruding portion other than the contact points, or these contact points may slide on each other, which cannot deny possible damage of the contact (s). This is desirably prevented.

SUMMARY OF THE INVENTION

A main object of the present invention is to further improve the conventional printers. A more specific object of the present invention is to provide a printer that allows a cartridge replacing operation to be easily performed. Another object of the present invention is to provide a printer simply configured to be able to protect electric contact points of a cartridge and those of a carriage. A further object of the present invention is to provide a printer that can prevent erroneous installation of an improper cartridge, thus preventing possible misrecognition and malfunctioning.

To accomplish the objects, the present invention provides a printer including a carriage including a housing portion housing a cartridge with a print head provided on a bottom surface and with a contact point portion provided on a rear surface, and a contact portion provided on an inner wall surface of the housing portion and electrically connected to the contact point portion of the cartridge housed in the housing portion; a cover provided on the carriage so as to be pivotally movable, the cover being able to be set in a closed state in which the cover presses a head of the cartridge housed in the housing portion and an open state in which the cover opens the housing portion when the cartridge is replaced; and a lever subjected to a bias force so as to protrude from the inner wall surface of the housing portion, the lever being movable against the bias force, the lever coming into contact with an end of the cartridge which faces the bottom surface when the cartridge is inserted into the housing portion, the lever contacting the rear surface of the cartridge housed in the housing portion, wherein the bias force is stronger when the cover is in the open state than when the cover is in the closed state.

Further objects and aspects of the present invention will be clear in the description below of an exemplary embodiment.

DESCRIPTION OF THE EMBODIMENTS

An exemplary embodiment of the present invention will be described below with reference to the drawings. The present invention is not limited to the dimensions, materials, shapes, or relative arrangements of components described in the exemplary embodiment unless otherwise specified.

Figure 1:
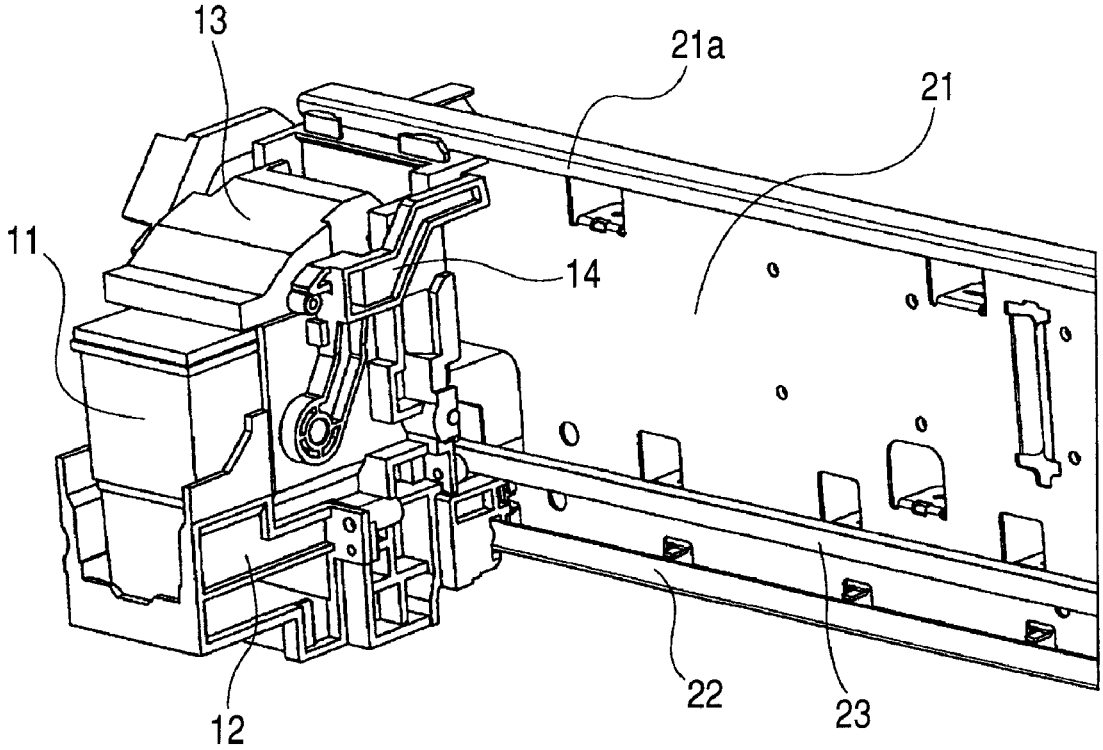
FIG. 1 is a perspective view showing an essential part of an ink jet printer.

FIG. 1 is a perspective view of an essential part of an ink jet-based print mechanism according to the exemplary embodiment. The exemplary embodiment includes a cartridge 11 and a carriage 12 on which the cartridge 11 is mounted and which moves in a direction crossing a direction in which sheets that are print media are conveyed. The carriage 12 is movably supported by a chassis rail 22 provided on a chassis 21 and a support rail 21*a* that is a part of the chassis 21. The carriage 12 is reciprocated by a driving mechanism including a motor. The cartridge 11, which includes an ink jet-based print head (an ink ejecting portion for ejecting ink) and an ink storage portion (ink tank) which are integrated together, is replaceable. A plurality of ink channels are formed inside the cartridge 11, which ink channels communicate with ink ejection ports. Actuators (energy generating elements) for ink ejection are provided in the respective ejection ports making up ejection port rows. Heating elements, piezo elements, MEMS elements or the like may be utilized for the actuators. In response to a signal input via the apparatus main body, the cartridge 11 ejects ink droplets. By exhaustion of ink, a user replaces the cartridge 11 with a new one.

A code strip 23 is extended and built along the chassis 21 substantially parallel to the chassis rail 22. An encoder mounted on the carriage 12 reads information on the code strip 23 to allow the cartridge 11 to eject ink droplets to a sheet at appropriate timings. When the carriage 12 reciprocates to complete one line of recording, a sheet conveying mechanism conveys a sheet over a required distance. The sheet is then stopped. Subsequently, the carriage 12 reciprocates again and ejects ink during the reciprocation. A recording (print) operation is thus performed. The operation is repeatedly performed to carry out recording on almost the entire surface of the sheet.

(Construction of the Cartridge and Carriage)

Figure 2A:
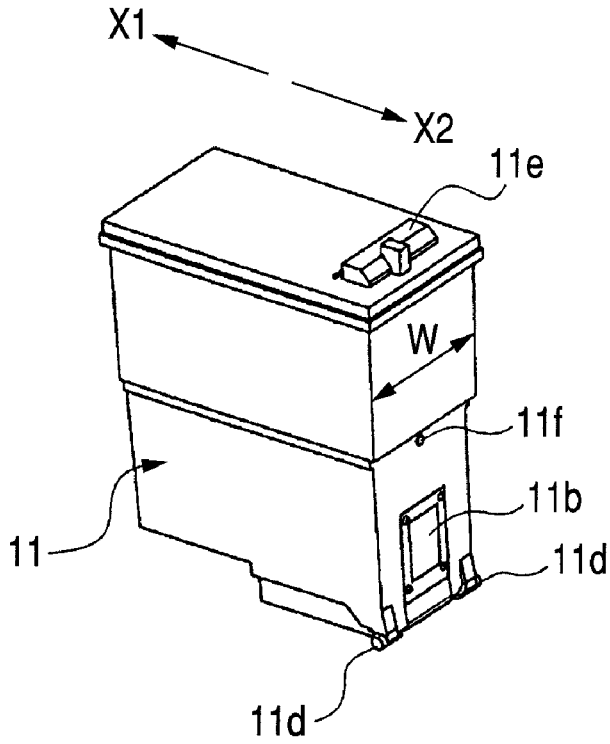
FIGS. 2A and 2B are perspective views showing a cartridge.
Figure 2B:
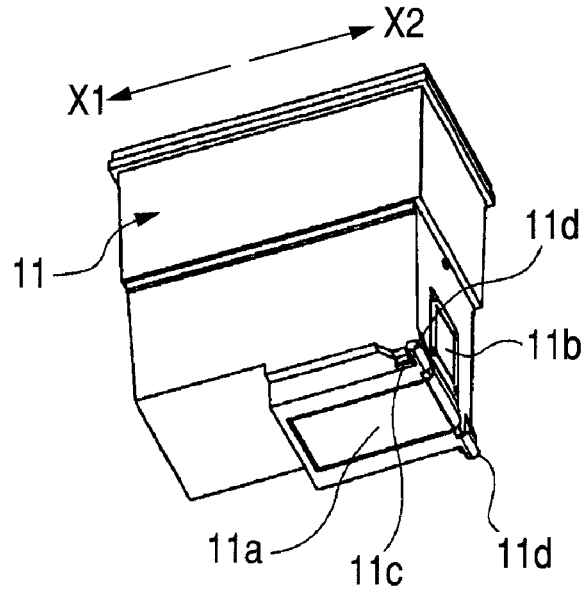

FIGS. 2A and 2B are perspective views of the cartridge 11 according to the exemplary embodiment. An ink ejecting portion 11*a* that is a print head is provided on the bottom surface of the cartridge 11. A contact point portion 11*b* is provided on the lower part of the rear surface of the cartridge 11. Positioning grooves 11*c* for positioning with respect to the carriage 12 are formed, near the bottom surface, in each of the opposite side surfaces of the cartridge 11. A rough guide protruding portion 11*d* is provided on the rear surface side of each of the positioning grooves 11*c*, where the contact point portion 11*b* is located. A protruding portion 11*e* is provided on the head (top surface) of the cartridge 11. A protruding portion 11*f* for positioning in the front-back direction of the carriage 12 (the direction of arrow X1 corresponds to the forward direction, and the direction of arrow X2 corresponds to the backward direction) is provided on the rear surface of the cartridge 11.

Figure 3:
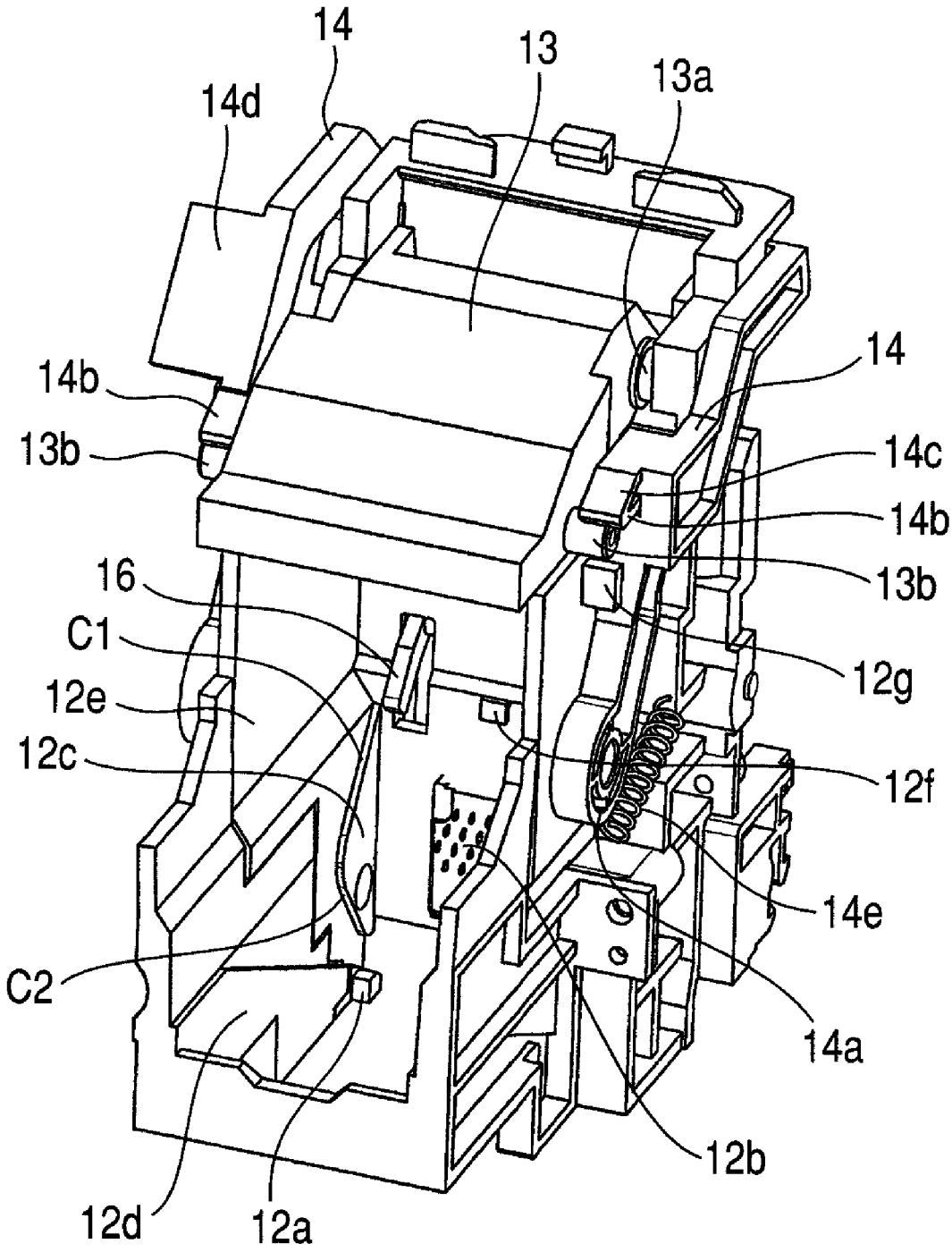
FIG. 3 is a perspective view showing a carriage.
Figure 4:
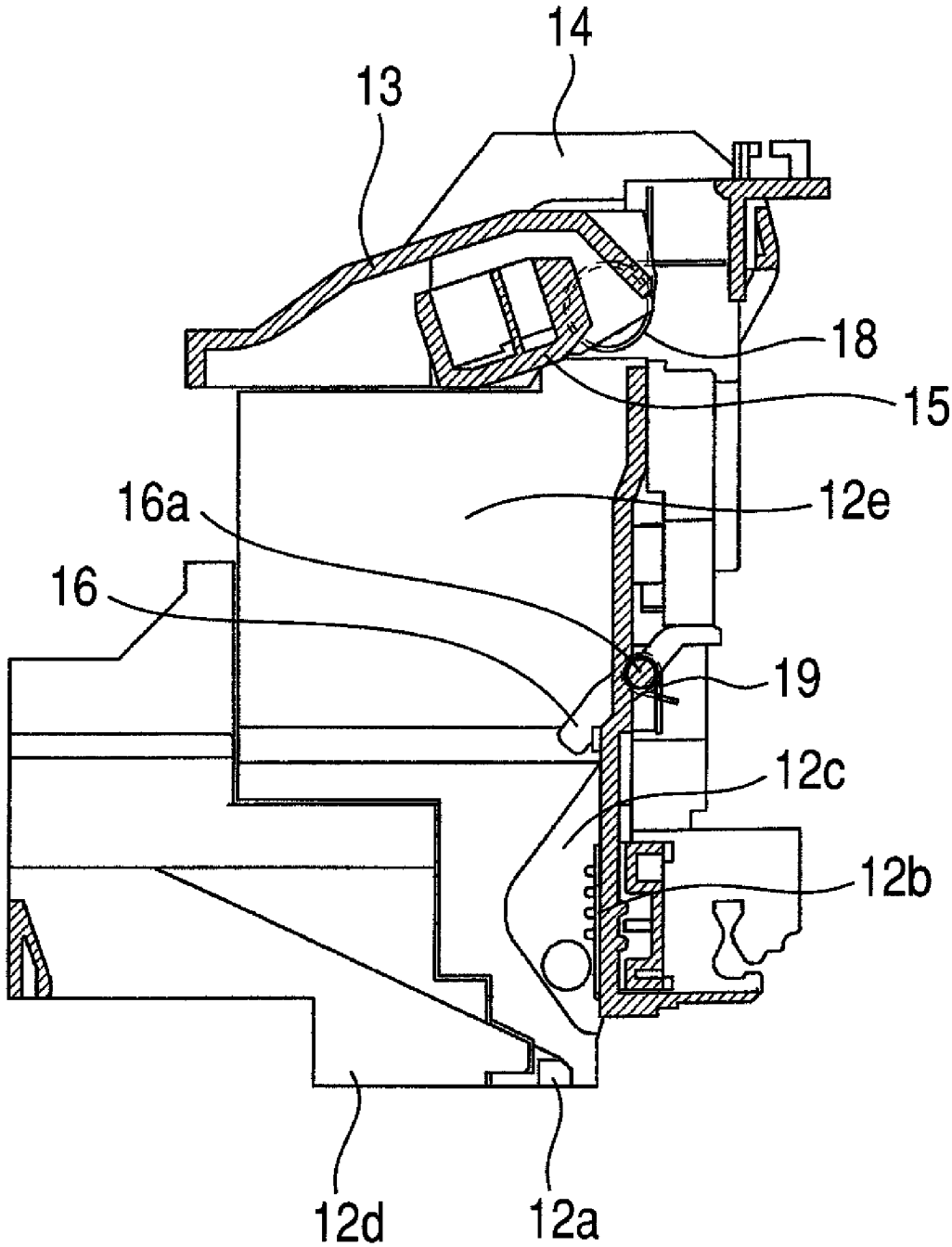
FIG. 4 is a sectional view showing the carriage.

FIG. 3 is a perspective view showing the structure of the carriage 12. FIG. 4 is a sectional view showing the structure of the carriage 12. A protruding portion 12*a* is provided on the bottom surface of a housing portion 12*e* of the carriage 12. A contact portion 12*b* is provided in the lower part of a rear inner wall surface of the housing portion 12*e*. The contact portion 12*b* is an electric contact point which abuts against the contact point portion 11*b* of the cartridge 11 and which is thus electrically connected to the contact point portion 11*b*. A first guide shape portion 12*c* and a second guide shape portion 12*d* are formed on an inner wall side surface of the carriage 12. The housing portion 12*e*, which houses the cartridge 11, corresponds to a portion enclosed by the side surfaces and rear surface of the inner wall of the carriage 12.

When the cartridge 11 is housed in the housing portion 12*e* of the carriage 12, the positioning grooves 11*c* of the cartridge 11 engages with the protruding portions 12*a* of the carriage 12. When the cartridge 11 is completely housed in the housing portion 12*e*, the contact point portion 11*b* of the cartridge 11 comes into abutting contact with the contact portion 12*b* of the carriage 12. When the cartridge 11 is installed in or removed from the housing portion 12*e* of the carriage 12, the first and second guide shape portions 12*c* and 12*d* of the inner wall side surface of the carriage 12 guide the rough guide protruding portions 11*d* of the cartridge 11. This enables smooth performance of the operation of installing and removing the cartridge 11 in and from the housing portion 12*e*. FIGS. 3 and 4 show the left side surface of the inner wall of the carriage 12, on which the protruding portion 12*a* and the first and second guide shape portions 12*c* and 12*d* are formed. Also, respective similar shape portions are also formed on the right side surface of the inner wall of the carriage 12. Furthermore, a protruding portion 12*f* is formed on the rear inner wall surface of the carriage 12 to allow the cartridge 11 to be positioned in the front-back direction when the cartridge 11 is installed.

(Construction of the Set Cover and Lock Lever)

The construction of a set cover 13 and a lock lever 14 which allow the cartridge 11 to be set in the carriage 12 will be described with reference to FIGS. 3 and 4. The set cover 13, which covers the head of the cartridge, is attached to the top part of the carriage 12 so as to be pivotally movable with respect to the carriage 12 around a rotating shaft 13*a* positioned in the rear of the top part of the carriage 12 as a rotating center. The lock lever 14 is attached to the carriage 12 so as to be pivotally movable with respect to the carriage 12 around a rotating shaft 14*a* as a rotating center. The set cover 13 can be set in a closed state in which the set cover 13 presses the head of the cartridge 11 housed in the housing portion 12*e* and in an open state in which the set cover 13 opens the housing portion 12*e* when the cartridge 11 is replaced with a new one.

A cylindrical protruding portion 13*b* is provided on each of the opposite side surfaces of the set cover 13 at a forward position thereof. Protruding portions 14*b* are provided on the lock lever 14 at positions where the protruding portions 14*b* engage with the corresponding cylindrical protruding portions 13*b*. In FIGS. 3 and 4, the set cover 13 is in the closed state. The set cover 13 and the lock lever 14 thus make up a lock mechanism in which when the set cover 13 is set in the closed state, the cylindrical protruding portions 13*b* of the set cover 13 engage with the protruding portions 14*b* of the lock lever 14 to lock pivotal movement of the set cover 13.

The set cover 13 is biased, by an elastic body 18 (first elastic body) made up of a spring, in a direction in which the set cover 13 moves pivotally around the rotating shaft 13*a* as a rotating center, in the clockwise direction in FIG. 4. The set cover 13 always acts to jump so as to shift from the closed state to the open state. However, the lock lever 14 locks the pivotal movement. When the user pushes a push portion 14*d* of the lock lever 14, the lock lever 14 slightly moves pivotally around the rotating shaft 14*a* as a rotating center. This cancels the lock between the protruding portions 14*b* of the lock lever 14 and the cylindrical protruding portions 13*b* of the set cover 13. The protruding portions 14*b* are thus separated from the cylindrical protruding portions 13*b*. Then, the set cover 13 jumps under the bias force of the elastic body 18 acting on the set cover 13. The set cover 13 is thus set in the open state. The lock lever 14 is biased, by the bias force of an elastic body 14*e* (third elastic body) that is a helical spring, in a direction in which the lock lever 14 moves pivotally around the rotating shaft 14*a* as a rotating center, in the counterclockwise direction in FIG. 4. When the user releases the user's hand from the push portion 14*d* of the lock lever 14, the bias force causes the lock lever 14 to automatically return and come into abutting contact with a lever stopper portion 12*g* of the carriage 12. The lock lever 14 is thus stopped.

On the other hand, to return the open set cover 13 to the closed state, the user holds the end of the set cover 13 and pivotally moves the set cover 13 in the counterclockwise direction in FIG. 4 against the bias force of the elastic body 18. An inclined surface 14*c* is formed on the top part of each of the protruding portions 14*b* of the lock lever 14. The cylindrical protruding portions 13*b* of the set cover 13 come into abutting contact with the corresponding inclined surfaces 14*c*. As the user continues to push the set cover 13, the cylindrical protruding portions 13*b* climb over the corresponding inclined surface 14*c* to return the set cover 13 to the closed state. The bias forces of the elastic bodies 18 and 14*e* are set so as to allow the user to easily perform the operation of rotating the set cover 13 and the lock lever 14.

Furthermore, a release lever 16 protrudes from the rear inner wall surface of the housing portion 12*e*. The release lever 16 is attached to the inner wall surface so as to be pivotally movable around a rotating shaft 16*a*. The release lever 16 is biased in the clockwise rotating direction in FIG. 4 by an elastic body 19 (second elastic body) made up of a spring. That is, the release lever 16 protrudes from the inner wall surface of the housing portion 12*e* under the bias force, and is movable against the bias force. As described below, the release lever 16 comes into contact with the bottom surface-side end (lower end) of the cartridge 11 while the cartridge 11 is being inserted into the housing portion 12*e*. Furthermore, the release lever 16 comes into contact with the rear surface of the cartridge 11 with the cartridge 11 housed in the housing portion 12*e*. Upon coming into contact with the cartridge 11 and being pressed by the cartridge 11, the release lever 16 moves pivotally in a direction in which the release lever 16 is retracted, against the bias force. Furthermore, when released from the cartridge 11, the release lever 16 automatically returns to the protruding state shown in FIG. 4, under the bias force.

(When the Cartridge 11 is Housed in the Carriage 12)

Figure 5:
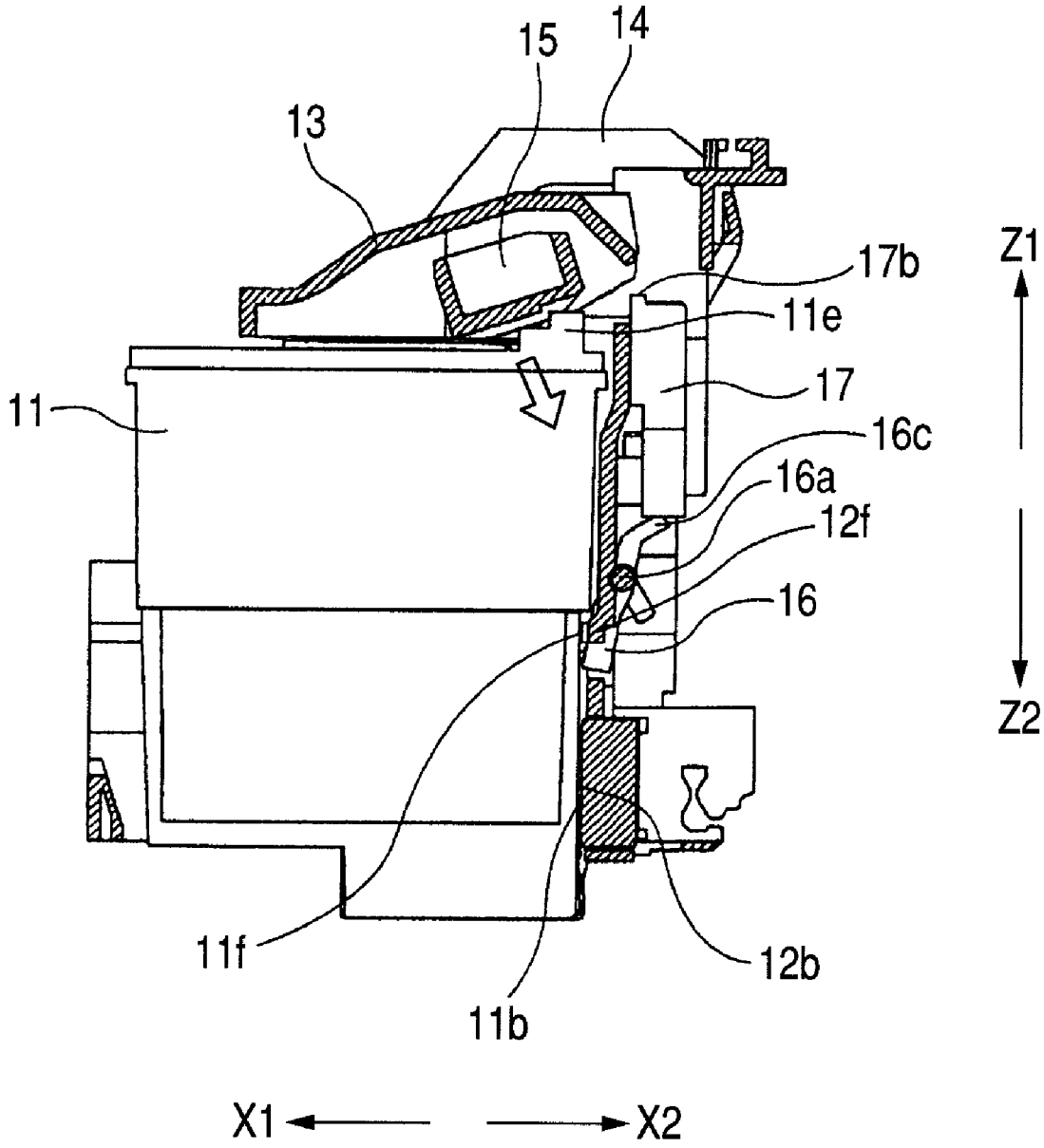
FIG. 5 is a sectional view showing that the cartridge is housed in the carriage.

FIG. 5 is a sectional view showing that the cartridge 11 is housed in the carriage 12. In FIG. 5, the set cover 13 is in the closed state. A presser portion 15 is supported on the bottom surface (which lies opposite the head of the cartridge 11) of the set cover 13. With the cartridge 11 housed in the carriage 12 and the set cover 13 closed, the presser portion 15 abuts against the protruding portion lie of the cartridge 11. The head of the cartridge 11 is thus pressed by the presser portion 15. The presser portion 15 biases the protruding portion lie in a direction (an oblique, rightward and downward direction shown by an arrow in FIG. 5) obtained by synthesizing the direction of arrow Z2 and the direction of arrow X2. That is, the direction in which the cartridge 11 is subjected to the force of the presser portion 15 is obtained by synthesizing the direction Z2 (the direction toward the interior of the housing portion 12*e*) and the direction X2 (the direction toward the rear inner wall surface of the housing portion 12*e*). Thus, the cartridge 11 is fixedly set inside the housing portion 12*e* so as to be positioned in the above-described two directions.

As shown in FIGS. 2A and 2B, together with the contact point portion 11*b*, the protruding portion 11*f* is provided on the rear surface (which is located in the direction of arrow X2 in FIG. 5) of the cartridge 11. On the other hand, as shown in FIG. 3, together with the contact portion 12*b*, the protruding portion 12*f* is provided on the rear inner wall surface of the housing portion 12*e* of the carriage 12. When the cartridge 11 is housed in the housing portion 12*e* and the set cover 13 is then closed, the contact point portion 11*b* of the cartridge 11 comes into abutting contact with the contact portion 12*b* of the carriage 12. At the same time, the protruding portion 11*f* of the cartridge 11 comes into abutting contact with the protruding portion 12*f* of the carriage 12. Furthermore, the positioning grooves 11*c* and protruding portion 11*f* of the cartridge 11 come into abutting contact with the protruding portions 12*a* and the protruding portion 12*f*, respectively, of the carriage 12. Thus, the cartridge 11 is precisely positioned in the housing portion 12*e* under the pressing force exerted on the protruding portion 11*e* of the cartridge 11 by the presser portion 15. A controller in the printer detects the electric connection between the contact point portion 11*b* of the cartridge 11 and the contact portion 12*b* of the carriage 12. The printer thus detects if the cartridge 11 has been installed.

The release lever 16 is pushed by the rear surface of the cartridge 11 to move to a position where the release lever 16 has little protrusion from the rear inner wall surface of the housing portion 12*e*. In this state, the force with which the release lever 16 presses the rear surface of the cartridge 11 does not hinder the electric connection between the contact point portion 11*b* and the contact portion 12*b*. In this manner, the exemplary embodiment adjusts the force with which the presser portion 15 presses the head of the cartridge 11 and the force with which the elastic body 19 biases the release lever 16.

(When the Cartridge 11 is Removed from the Carriage 12)

Figure 6:
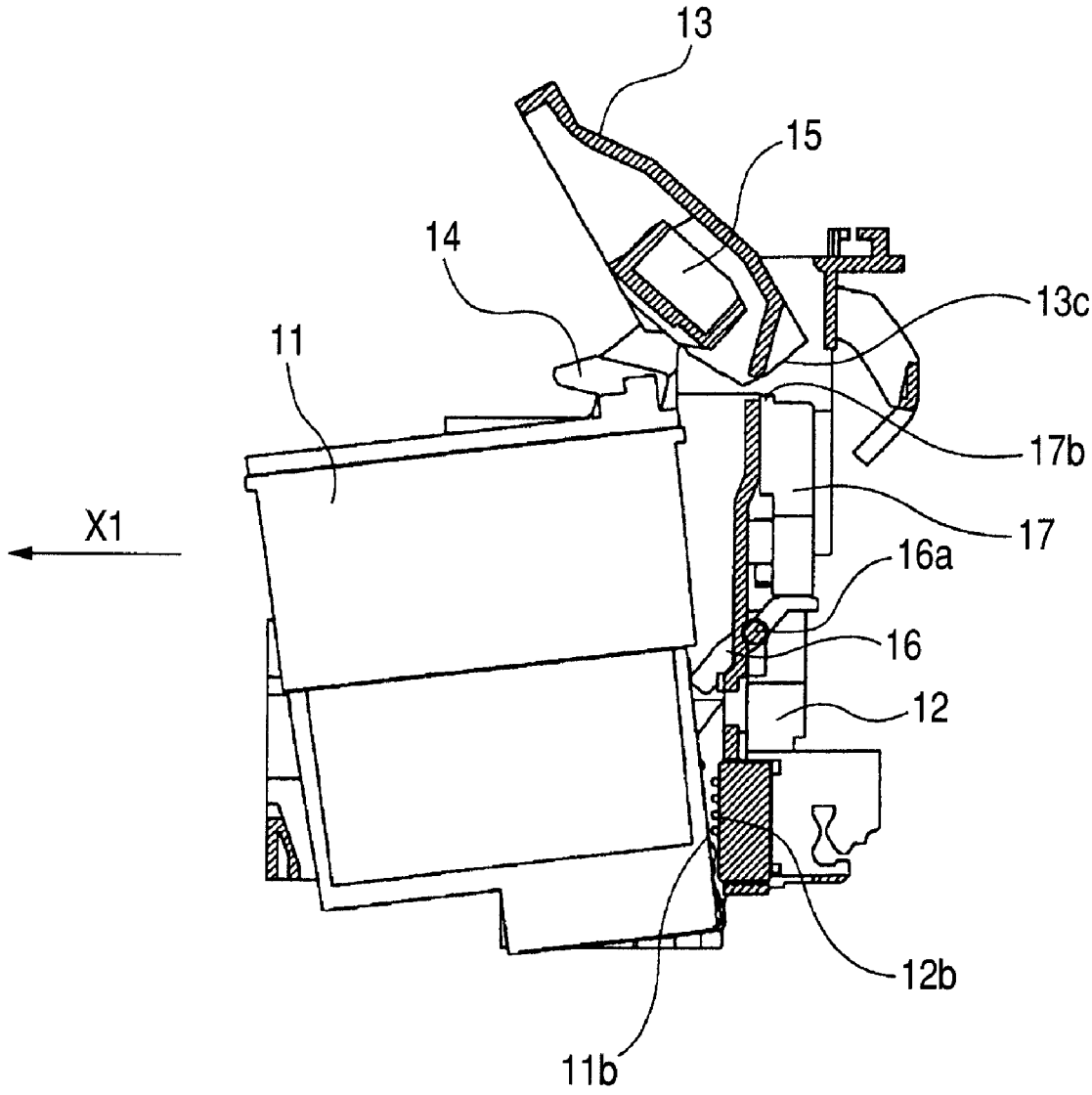
FIG. 6 is a sectional view showing that the cartridge is removed from the carriage.

FIG. 6 is a sectional view showing a state at a certain moment during removal of the cartridge 11 from the housing portion 12*e*. FIG. 6 shows that the set cover 13 is being switched from the closed state to the open state. To remove the cartridge 11 from the carriage 12, the user operates the lock lever 14 to cancel the lock, allowing the set cover 13 to jump, as described above. FIG. 6 shows that the set cover 13 is being jumped.

The presser portion 15 of the set cover 13 separates from the head of the cartridge 11 to eliminate the force with which the cartridge 11 is pressed. At the same time, the release lever 16, biased by the elastic body 19, presses the rear surface of the cartridge 11 to push out the cartridge 11 in the direction of arrow X1. The cartridge 11 is thus tilted forward. The tilted posture of the cartridge 11 allows the contact point portion 11*b* of the cartridge 11 to be separated from the contact portion 12*b* of the carriage 12. Thus, the contact portions 11*b* and 12*b* are electrically disconnected from each other. The set cover 13 is further pivotally moved from the state shown in FIG. 6 under the bias force of the elastic body 18. The set cover 13 is finally set in the open state shown in FIG. 7. Then, as described below, the force with which the release lever 16 presses the rear surface of the cartridge 11 is further increased. The contact points can thus be more reliably separated from each other.

Figure 7:
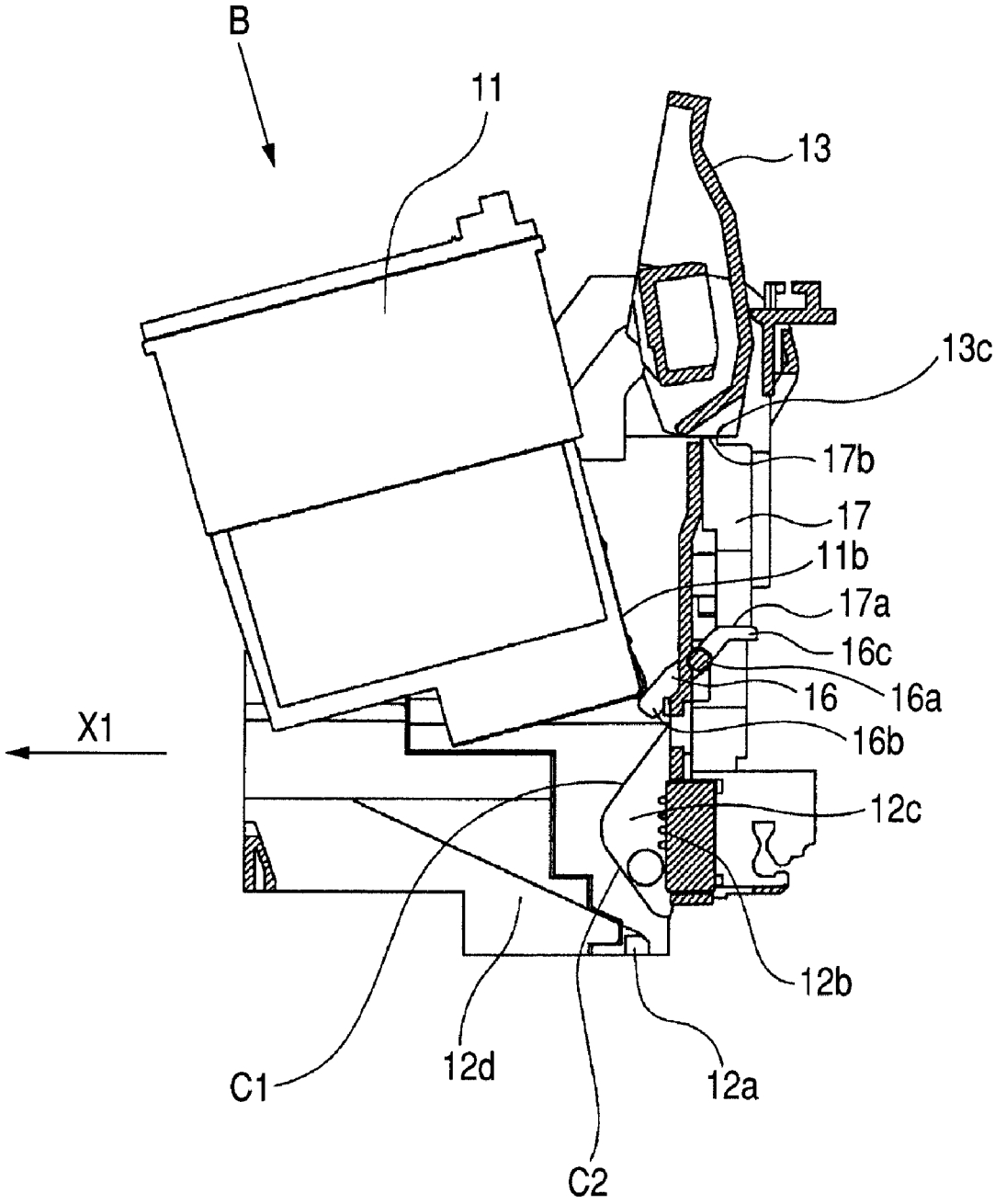
FIG. 7 is a sectional view showing that the cartridge is installed in the carriage.

The shape of the set cover 13 is such that in the closed state, the set cover 13 covers at least a part (a part or all of) the top surface of the cartridge 11, while avoiding covering the front surface of the cartridge 11 (the shape includes no L-shaped projection). Thus, when the set cover 13 is in the open state as shown in FIG. 7, no part of the set cover 13 protrudes in the direction of arrow X1, corresponding to the forward direction of the printer. Consequently, when the cartridge 11 is taken out of the carriage 12 upward, no part of the set cover 13 hinders the operation. That is, a large space is available for the cartridge replacing operation, allowing the user to easily perform the replacing operation. Additionally, the set cover 13 may be shaped to not only cover the top surface of the cartridge 11 but also slightly cover the front surface thereof. This is because the replacing operation is not hindered by a projection that only slightly covers the front surface of the cartridge 11. That is, the set cover 13 is shaped to lie along the top surface of the cartridge 11 in the closed state shown in FIG. 5. The shape lying along the top surface means both the shape covering a part or all of the top surface and the shape not only covering the top surface of the cartridge 11 but also slightly covering the front surface of thereof. The shape does not mean one having many projections that hinder the replacing operation as in the case of the above-described conventional art.

(When the Cartridge 11 is Installed in the Carriage 12)

FIG. 7 is a sectional view showing that the cartridge 11 is inserted into the carriage 12. The set cover 13 is fully open and thus it is in the open state. The user inserts the cartridge 11 into the housing portion 12*e* while the set cover 13 is in the open state. Since the above-described shape of the set cover 13 ensures a large operation space above the housing portion 12*e*, the user can properly perform the operation. The release lever 16 also functions as a protecting member that protects the respective electric contact points of the cartridge and the housing portion when the cartridge 11 is inserted into the housing portion 12*e*. As described below, a strong bias force is applied to the tips 16*b* of the release lever 16, which thus protrude from the inner wall surface of the housing portion 12*e* of the carriage 12. When the cartridge 11 is inserted into the carriage 12, the tips 16*b* of the release lever 16 come into contact with the bottom surface-side end of the cartridge 11 to push back the cartridge 11 in a direction including the direction X1 as shown in FIG. 7. The cartridge 11 is thus prevented from colliding hard against the rear inner wall surface of the housing portion 12*e*. Thus, when the cartridge 11 is inserted into the carriage 12 from the direction of arrow B, the release lever 16 acts to prevent the contact point portion 11*b* on the rear surface of the cartridge 11 from contacting the protruding portion 12*f* on the inner wall surface of the housing portion 12*e*.

The release lever 16 has an end 16*c* formed opposite the tips 16*b*, which protrude out from the inner wall surface, across the rotating shaft 16*a*. The lower end 17*a* of a release guide 17 comes into abutting contact with the end 16*c*. On the other hand, the rear end 13*c* of the open set cover 13 comes into abutting contact with the upper end 17*b* of the release guide 17. The release guide 17 is a force transmitting member that contacts a part of the set cover 13 and a part of the release lever 16 to transmit a force between the set cover 13 and the release lever 16. When the set cover 13 changes from the closed state to the open state, the bias force of the elastic body 18 of the set cover 13 acts on the end 16*c* of the release lever 16 via the release guide 17. This increases a bias force acting in the direction in which the release lever 16 protrudes out from the inner wall surface. On the other hand, when the set cover 13 is in the closed state, the bias force of the elastic body 18 does not act on the release lever 16. That is, in the open state, the release lever 16 is biased in the direction in which the release lever 16 protrudes out from the inner wall surface, under a strong force corresponding to the sum of the bias force exerted on the release lever 16 by the elastic body 19 (second elastic body) and the bias force exerted on the set cover 13 by the elastic body 18 (first elastic body). When the cartridge 11 is pushed in with a force stronger than the above-described strong bias force, the release lever 16 moves pivotally to allow the cartridge 11 to be inserted into the carriage 12. In the open state, the strong bias force exerted on the release lever 16 allows the contacts to be effectively protected.

In the state shown in FIG. 7, when the user further pushes in the cartridge 11, the rough guide protruding portions 11*d* of the cartridge 11 come into abutting contact with the corresponding top surfaces C1 of the guide portions 12*c* at the side wall of the carriage 12. The cartridge 11 thus moves in the direction of arrow X1 along the top surfaces C1. As the cartridge 11 moves further downward, the rough guide protruding portions 11*d* move along the second guide portions 12*d*. Finally, the positioning grooves 11*c* of the cartridge 11 come into abutting contact with the corresponding protruding portions 12*a* of the housing portion 12*e*. In this state, when the user closes the set cover 13, the carriage is brought into the state shown in FIG. 5. The operation of installing the cartridge 11 in the housing portion 12*e* is thus completed.

As described above, when the cartridge 11 is inserted into the housing portion 12*e*, the release lever 16 comes into contact with the bottom surface-side end of the cartridge 11. The release lever 16 also comes into contact with the rear surface of the cartridge 11 housed in the housing portion 12*e*. The bias force applied to the release lever 16 is stronger when the set cover 13 is in the open state than when the set cover 13 is in the closed state. In other words, the bias force applied to the release lever 16 changes depending on whether the set cover is open or closed. Thus, the release lever 16 effectively protects the electric contact points during the insertion of the cartridge. After the cartridge is set in the carriage, the release lever 16 presses the rear surface of the cartridge 11 with the appropriate force. When the set cover 13 is opened to allow the cartridge 11 to be removed, the release lever 16 pushes out the cartridge to enable the electric connection between the contacts to be reliably broken. When the cartridge 11 is inserted into the housing portion 12*e*, the contact point portion 11*b* on the rear surface of the cartridge 11 is prevented from contacting the protruding portion 12*f* on the inner wall surface of the housing portion 12*e*. The present embodiment also prevents the possible contact between the end of the cartridge 11 and the contact portion 12*b* and possible violent sliding of the contact point portions 11*b* and the contact portion 12*b* on each other. As a result, both contacts are protected from damage.

Figure 8:
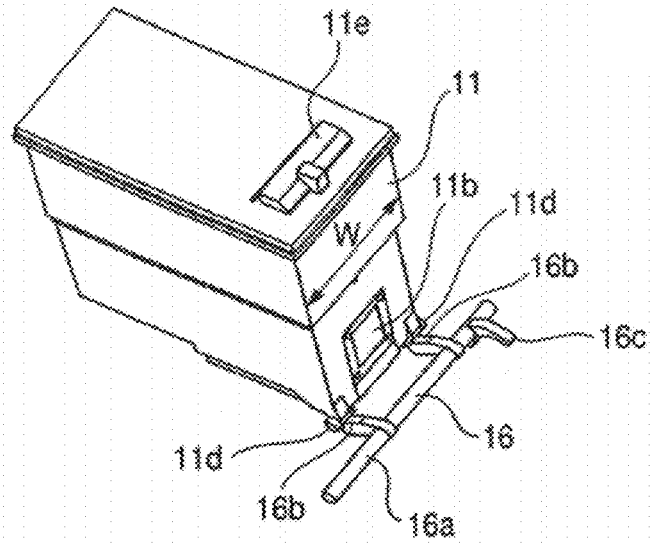
FIG. 8 is a partial perspective view showing that the cartridge is installed in the carriage.

As shown in FIG. 8, the contact point portion 11*b* of the cartridge 11 is located in an area including a widthwise (the direction of arrow W) central part of the cartridge 11. The release lever 16 protrudes to a position where the release lever 16 does not contact the contact point portion 11*b* but does the bottom and rear surface of the cartridge 11. The tips 16*b* of the release lever 16 protrude from the respective positions located away from each other in the width direction. The tips 16 symmetrically contact the cartridge 11 on the respective sides of the contact point portion 11*b*. This construction prevents the release lever 16 from coming into abutting contact with the contact point portion 11*b* to damage the contact point portion 11*b* when the cartridge 11 is inserted into the housing portion 12*e*. Furthermore, the release lever 16 presses the rear surface of the cartridge at the two positions on the respective sides of the contact point portion 11*b*. Thus, the cartridge 11 can be stably pushed out.

Figure 9:
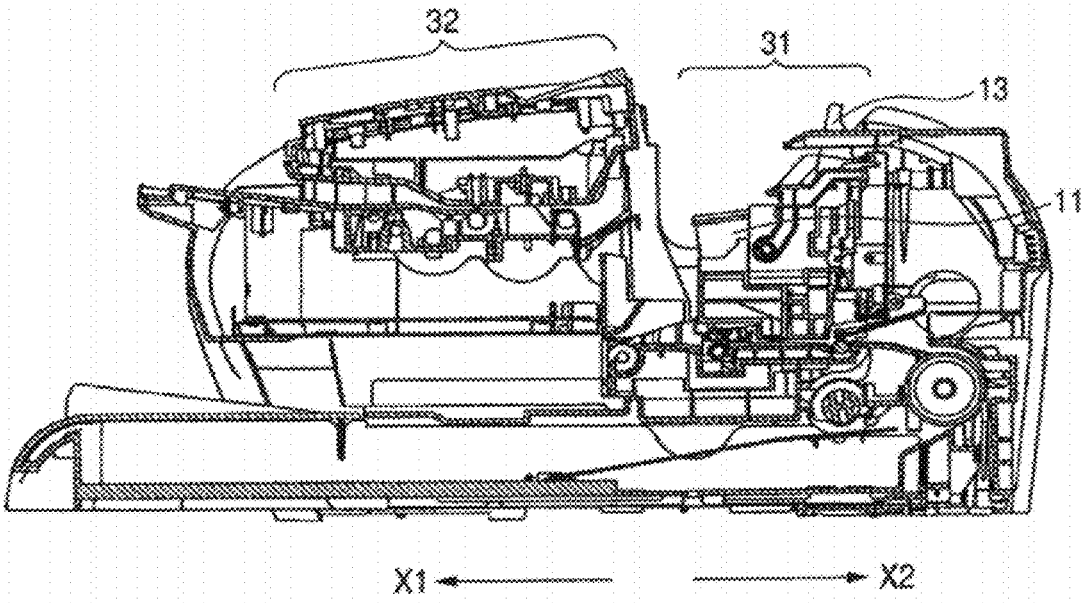
FIG. 9 is a sectional view showing the general construction of the apparatus.

FIG. 9 is a sectional view showing the general construction of an ink jet-based multifunction printer (image reading and recording apparatus) in which the above-described print mechanism is mounted. In FIG. 9, the side of arrow X1 corresponds to the front of the apparatus. The side of arrow X2 corresponds to the rear of the apparatus. An operation panel and a scanner 32 are arranged in the upper part of the front side of the apparatus. A print portion 31 is located behind the scanner 32. To be replaced with a new one, the cartridge 11 is taken out of the print portion 31 upward. When the set cover 13 is in the open state, a sufficient operation space is available above the cartridge 11. Thus, the replacing operation can be very efficiently performed.

Figure 10:
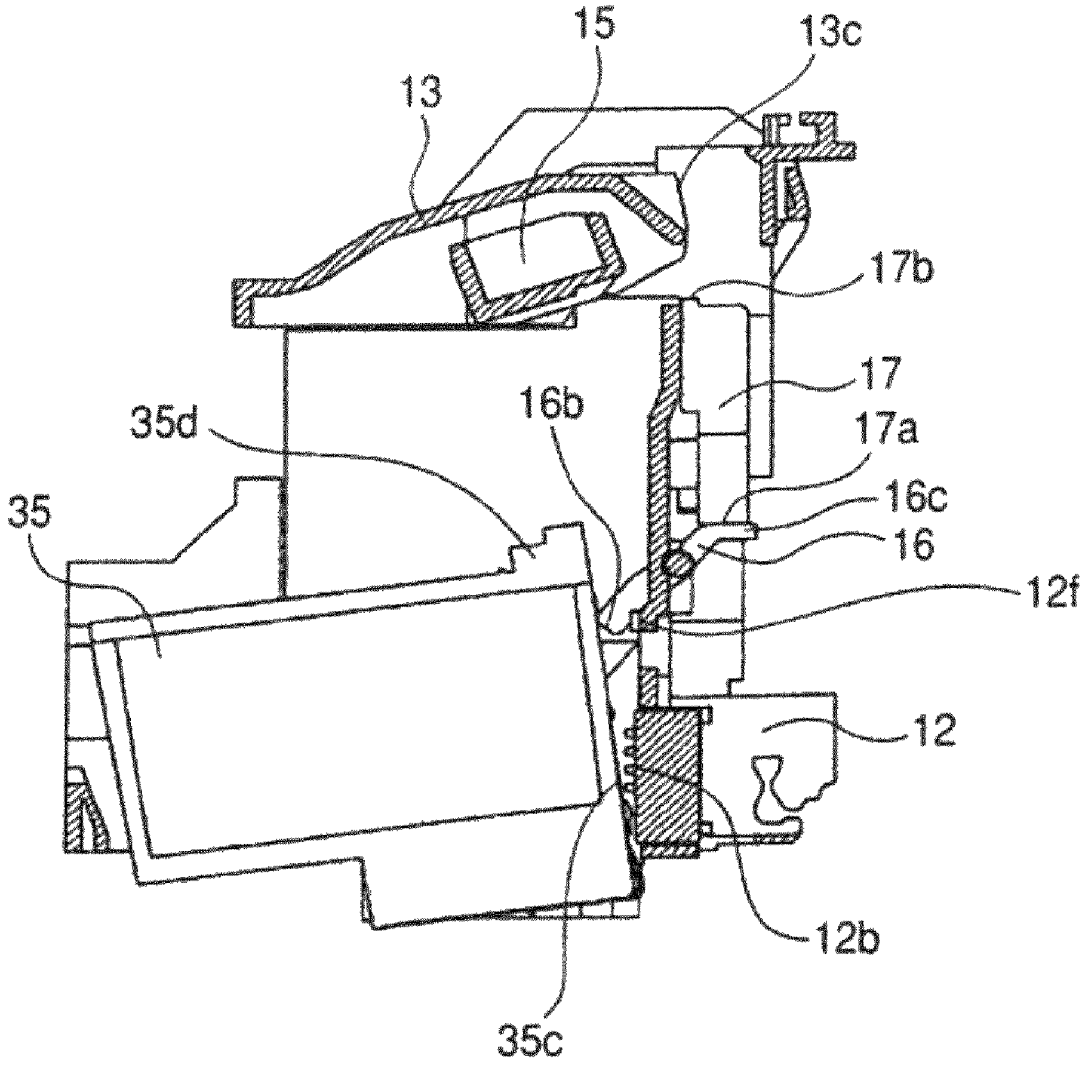
FIG. 10 is a diagram showing that an improper cartridge is inserted into the carriage.

Now, a mechanism preventing possible erroneous installation and misrecognition when an attempt is made to install an improper cartridge (second cartridge 35) other than the proper cartridge (first cartridge 11) will be described with reference to FIG. 10. Here, the improper second cartridge 35 is shaped to have a smaller height than the proper first cartridge 11.

Even when the second cartridge 35 is inserted into the carriage 12 and the set cover 13 is pivotally moved and set in the closed state, the presser portion 15 fails to come into abutting contact with a protruding portion 35*d* on the head of the second cartridge 35. Thus, the presser portion 15 fails to press the second cartridge 35. In this case, when the contact point portion 35*c* of the second cartridge 35 comes into contact with the contact portion 12*b* of the carriage 12, misrecognition or malfunctioning may occur. To prevent this, the release lever 16 pushes the rear surface of the second cartridge 35 to separate the contact point portion 35*c* of the second cartridge 35 from the contact portion 12*b* of the carriage 12. In this example, the release lever 16 protrudes from the vicinity of the center (substantially central part) of the inner wall surface of the housing portion 12*e* in the cartridge inserting direction. The position of the release lever 16 in the cartridge inserting direction is such that the release lever 16 presses the rear surface of the second cartridge 35 at a height appropriate for the cartridge to be prevented from being erroneously installed.

Thus, even when an attempt is made to install the improper cartridge 35, which is smaller than the first cartridge 11, the release lever 16 pushes the rear surface of the second cartridge 35 to push the cartridge 35 forward. Thus, even when the set cover 13 is closed, the second cartridge 35 cannot be correctly set in the carriage. Therefore, the contact point portion 35*c* of the second cartridge 35 can be prevented from contacting the contact portion 12*b* of the carriage 12. As a result, possible misrecognition and malfunctioning can be prevented.

In the above description, the expressions "top", "upper" and "above" and "bottom", "lower" and "below" do not necessarily mean the up-down direction in the direction of gravity. The direction in which the cartridge 11 is inserted into the housing portion 12*e* may be a horizontal direction or a direction oblique to the horizontal direction. In this case, the inserting direction is considered to be the up-down direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-122401, filed May 8, 2008, and Japanese Patent Application No. 2009-050921, filed Mar. 4, 2009, which are hereby incorporated by reference herein in its their entirety.

What is claimed is:

1. A printer comprising:

a carriage including a housing portion configured to house a cartridge, the housing portion including a contact portion provided on an inner wall surface of the housing portion which is configured to electrically connect to a contact point portion of the cartridge when housed in the housing portion;

a cover provided on the carriage and configured to be pivotally movable and able to be set in a closed state, where the cover presses the cartridge housed in the housing portion, and an open state, where the cover opens the housing portion when the cartridge is replaced;

a lever configured to rotationally move and which is biased in a direction where a first portion of the lever protrudes from the inner wall surface of the housing portion; and a transmitting member configured to transmit a force in conjunction with rotational movement of the lever so that a second portion of the lever is rotationally moved in a direction towards the inner wall surface of the housing portion, wherein when the cover is in the open state the transmitting member abuts the cover, and when the cover is in the closed state the transmitting member does not abut with the cover.

2. The printer according to claim 1, further comprising:

a first elastic body biasing the cover in a direction in which the cover changes from the closed state to the open state, wherein when the cover is set in the open state, a force of the first elastic body acts on the lever to increase a bias force of the lever, and when the cover is in the closed state, the force of the first elastic body does not act on the lever.

3. The printer according to claim 2, further comprising:

a second elastic body biasing the lever in the direction in which the first portion of the lever protrudes out from the inner wall surface of the housing portion, the second elastic body being different from the first elastic body.

4. The printer according to claim 3, wherein the transmitting member contacts a part of the cover and a part of the lever to transmit a force between the cover and the lever in the open state.

5. The printer according to claim 2, further comprising:

a lock mechanism configured to engage the cover set in the closed state, so as to lock pivotal movement of the cover against biasing by the first elastic body.

6. The printer according to claim 1, wherein the cover is configured to lie along a top surface of the cartridge in the closed state.

7. The printer according to claim 1, wherein, the cover includes a presser portion that is configured to apply a force to the head of the cartridge, housed in the housing portion when the cartridge is set in a closed state, in a direction corresponding to a combination of a direction toward an interior of the housing portion and a direction toward a rear inner wall surface of the housing portion, so as to fix the cartridge in the housing portion.

8. The printer according to claim 1, further comprising:

a protruding portion formed on the inner wall surface of the housing portion to position the cartridge, wherein the lever prevents contact between the protruding portion and the contact point portion when the cartridge is inserted into the housing portion.

9. The printer according to claim 1, wherein the contact point portion is located in an area of a rear surface of the cartridge that includes a central part in a width direction, and the lever protrudes to a position where the lever does not contact the contact point position.

10. The printer according to claim 9, wherein the lever protrudes from two positions located away from each other in the width direction and contacts the rear surface of the cartridge without contacting the contact point portion.

11. The printer according to claim 9, wherein the lever protrudes from a vicinity of a center of the inner wall surface in a direction in which the cartridge is inserted.

12. The printer according to claim 1, further comprising:

the cartridge, in which the print head ejecting ink is integrated with an ink tank in which the ink is stored.

* * * * *